US011371472B2

(12) United States Patent
Saito

(10) Patent No.: US 11,371,472 B2
(45) Date of Patent: Jun. 28, 2022

(54) CORROSION RESISTANT DEVICE

(71) Applicant: DENSO CORPORATION, Kariya (JP)

(72) Inventor: Yuji Saito, Kariya (JP)

(73) Assignee: DENSO CORPORATION, Kariya (JP)

( * ) Notice: Subject to any disclaimer, the term of this patent is extended or adjusted under 35 U.S.C. 154(b) by 781 days.

(21) Appl. No.: 16/293,750

(22) Filed: Mar. 6, 2019

(65) Prior Publication Data

US 2019/0285039 A1 Sep. 19, 2019

(30) Foreign Application Priority Data

Mar. 15, 2018 (JP) ..... JP2018-048408
Jan. 14, 2019 (JP) ..... JP2019-003979

(51) Int. Cl.

| | |
|---|---|
| ***F02M 26/50*** | (2016.01) |
| ***F02M 61/18*** | (2006.01) |
| *F02M 63/00* | (2006.01) |
| *F02M 21/02* | (2006.01) |

(52) U.S. Cl.

CPC ..... *F02M 26/50* (2016.02); *F02M 61/18* (2013.01); *F02M 21/0296* (2013.01); *F02M 63/0078* (2013.01); *F02M 2200/05* (2013.01); *F02M 2200/9061* (2013.01)

(58) Field of Classification Search

CPC ..... F02M 2200/05; F02M 2200/9038; F02M 2200/9061

See application file for complete search history.

(56) References Cited

U.S. PATENT DOCUMENTS 5,967,423 A * 10/1999 Sumida ..... F02M 61/10 239/533.12
6,027,050 A * 2/2000 Rembold ..... F02M 51/0671 239/463
6,224,002 B1 * 5/2001 Reiter ..... F02M 51/0653 239/533.12
6,267,307 B1 * 7/2001 Pontoppidan ..... F02M 61/188 239/585.4

(Continued)

FOREIGN PATENT DOCUMENTS

CN 1405355 A * 3/2003
DE 102017109452 A1 * 11/2017 ..... C23C 28/347

(Continued)

*Primary Examiner* — Kevin R Steckbauer
(74) *Attorney, Agent, or Firm* — Nixon & Vanderhye P.C.

(57) ABSTRACT

A first member has a plated layer. A second member is pressed against the plated layer and causes a tensile stress in the first member. A breakage probability is a probability of breakage of the plated layer caused by the tensile stress. A characteristic line represents a relationship between an elastic modulus of the plated layer and the breakage probability. A characteristic slope of the characteristic line is a ratio of an increase in the breakage probability to a decrease in the elastic modulus. A characteristic change point appears on the characteristic line at which the elastic slope increases to exceed a predetermined slope as the elastic modulus gradually decreases. A characteristic change elastic modulus is the elastic modulus at the characteristic change point. The plated layer contains at least a chromium component and has the elastic modulus larger than the characteristic change elastic modulus.

12 Claims, 8 Drawing Sheets

(56) References Cited

U.S. PATENT DOCUMENTS 6,273,348 B1 * 8/2001 Shouji ..... F02M 51/0678 239/585.1
6,296,199 B1 * 10/2001 Noller ..... F02M 51/0671 239/533.12
6,364,220 B2 * 4/2002 Willke ..... F02M 61/188 239/585.1
6,405,935 B2 * 6/2002 Dantes ..... F02M 61/162 239/5
6,431,473 B2 * 8/2002 Shouji ..... B05D 5/083 239/585.1
6,443,375 B2 * 9/2002 Shouji ..... F02M 61/18 239/585.1
6,489,043 B1 * 12/2002 Deevi ..... C23C 8/10 428/681
6,601,786 B2 * 8/2003 Yamaguchi ..... F02M 51/0682 239/533.9
6,668,793 B2 * 12/2003 Okamoto ..... F02B 31/08 123/299
6,676,044 B2 * 1/2004 Dallmeyer ..... F02M 51/005 239/585.1
6,695,233 B2 * 2/2004 Sekine ..... F02M 61/168 239/585.1
6,793,162 B2 * 9/2004 Dallmeyer ..... F02M 51/0682 239/585.1
6,908,050 B2 * 6/2005 Sekine ..... F02M 61/168 239/585.1
6,938,840 B1 * 9/2005 Trutschel ..... F02M 51/0671 239/463
6,991,219 B2 * 1/2006 Aharonov ..... F02M 61/166 123/90.48
7,051,961 B2 * 5/2006 Mills ..... F02M 51/0682 239/533.2
7,086,606 B2 * 8/2006 Brooks ..... F02M 51/0614 239/5
7,309,033 B2 * 12/2007 Dallmeyer ..... F02M 51/005 239/585.1
7,347,383 B2 * 3/2008 Dallmeyer ..... F02M 61/18 239/5
7,389,952 B2 * 6/2008 Dallmeyer ..... F02M 51/005 239/585.1
7,422,165 B2 * 9/2008 Cernoia ..... F02M 61/18 239/585.1
7,429,006 B2 * 9/2008 Dallmeyer ..... F02M 61/168 239/585.1
8,006,715 B2 * 8/2011 Shafer ..... F02M 61/1886 137/375
10,151,285 B2 * 12/2018 Seki ..... F02M 55/008
10,208,722 B2 * 2/2019 Kato ..... F02M 61/18
10,280,886 B2 * 5/2019 Sugaya ..... F02M 51/0685
10,280,887 B2 * 5/2019 Kato ..... F02M 61/14
10,309,356 B2 * 6/2019 Oikawa ..... F02M 51/0671
10,415,527 B2 * 9/2019 Miyake ..... F02M 61/188
10,626,834 B2 * 4/2020 Liu ..... C23C 28/322
10,808,662 B2 * 10/2020 Yamamoto ..... F02M 61/161
10,941,739 B2 * 3/2021 Oikawa ..... F02M 51/061
2001/0002681 A1 * 6/2001 Willke ..... F02M 61/188 239/585.4
2001/0032896 A1 * 10/2001 Shouji ..... F02M 69/045 239/585.1
2001/0040194 A1 * 11/2001 Yamaguchi ..... F02M 61/18 239/585.4
2001/0042801 A1 * 11/2001 Shouji ..... F02M 61/18 239/585.1
2001/0048035 A1 * 12/2001 Dantes ..... F02M 61/162 239/5
2002/0043575 A1 * 4/2002 Sekine ..... F02M 51/0685 239/585.1
2002/0047054 A1 * 4/2002 Dallmeyer ..... F02M 61/18 239/585.1
2002/0050267 A1 * 5/2002 Okamoto ..... F02M 61/1806 123/305
2003/0019958 A1 * 1/2003 Dallmeyer ..... F02M 51/0614 239/585.1
2003/0226914 A1 * 12/2003 Mills ..... F02M 51/0682 239/585.4
2004/0046066 A1 * 3/2004 Dallmeyer ..... F02M 51/0614 239/585.1
2004/0129313 A1 * 7/2004 Aharonov ..... F02M 61/18 137/375
2004/0135014 A1 * 7/2004 Sekine ..... F02M 61/12 239/585.1
2005/0006492 A1 * 1/2005 Brooks ..... F02M 61/18 239/5
2005/0133630 A1 * 6/2005 Hornby ..... B29C 66/5344 239/533.2
2006/0071101 A1 * 4/2006 Dallmeyer ..... F02M 61/18 239/585.1
2006/0076437 A1 * 4/2006 Dallmeyer ..... F02M 61/168 239/585.1
2006/0076438 A1 * 4/2006 Dallmeyer ..... F02M 61/165 239/585.1
2006/0086829 A1 * 4/2006 Cernoia ..... F02M 61/18 239/533.2
2008/0035130 A1 * 2/2008 Arndt ..... F02M 61/162 123/590
2009/0078906 A1 * 3/2009 Shafer ..... F02M 61/18 251/368
2017/0082077 A1 * 3/2017 Kato ..... F02M 61/18
2017/0292488 A1 * 10/2017 Sugaya ..... F02M 61/168
2017/0321645 A1 * 11/2017 Liu ..... C23C 28/341
2017/0356409 A1 * 12/2017 Seki ..... F02M 61/16
2018/0010564 A1 * 1/2018 Miyake ..... F02M 61/18
2018/0030943 A1 * 2/2018 Kato ..... F02M 61/18
2018/0245557 A1 * 8/2018 Oikawa ..... F02M 51/0653
2019/0024618 A1 * 1/2019 Yamamoto ..... F02M 51/0689
2019/0162149 A1 * 5/2019 Yamashita ..... F02M 61/166
2019/0242347 A1 * 8/2019 Oikawa ..... F02M 51/0653
2019/0285039 A1 * 9/2019 Saito ..... F02M 61/14
2020/0217287 A1 * 7/2020 Cha ..... C23C 14/34
2021/0277861 A1 * 9/2021 Mochizuki ..... F02M 51/0685
2021/0355266 A1 * 11/2021 Tanaka ..... C09D 175/14

FOREIGN PATENT DOCUMENTS

EP 2 052 789 4/2009
FR 2766239 A1 * 1/1999 ..... F02M 61/188
JP S51-72618 6/1976
JP H05-209575 8/1993
JP 2004107717 A * 4/2004
JP 2008-069678 3/2008
WO WO-2018221561 A1 * 12/2018 ..... C22C 19/05

* cited by examiner

CORROSION RESISTANT DEVICE

CROSS REFERENCE TO RELATED APPLICATION

This application is based on Japanese Patent Applications No. 2018-48408 filed on Mar. 15, 2018 and No. 2019-3979 filed on Jan. 14, 2019, the disclosure of which is incorporated herein by reference.

TECHNICAL FIELD

The present disclosure relates to a corrosion resistant device.

BACKGROUND

Conventionally, a fuel injection valve is used in an internal combustion engine. A fuel injection valve typically includes a metallic nozzle formed with an injection hole for injecting fuel.

SUMMARY

According to an aspect of the present disclosure, a first member has a plated layer. A second member is pressed against a portion of the first member on which the plated layer is applied. The plated layer may have a specific property.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

Figure 1:
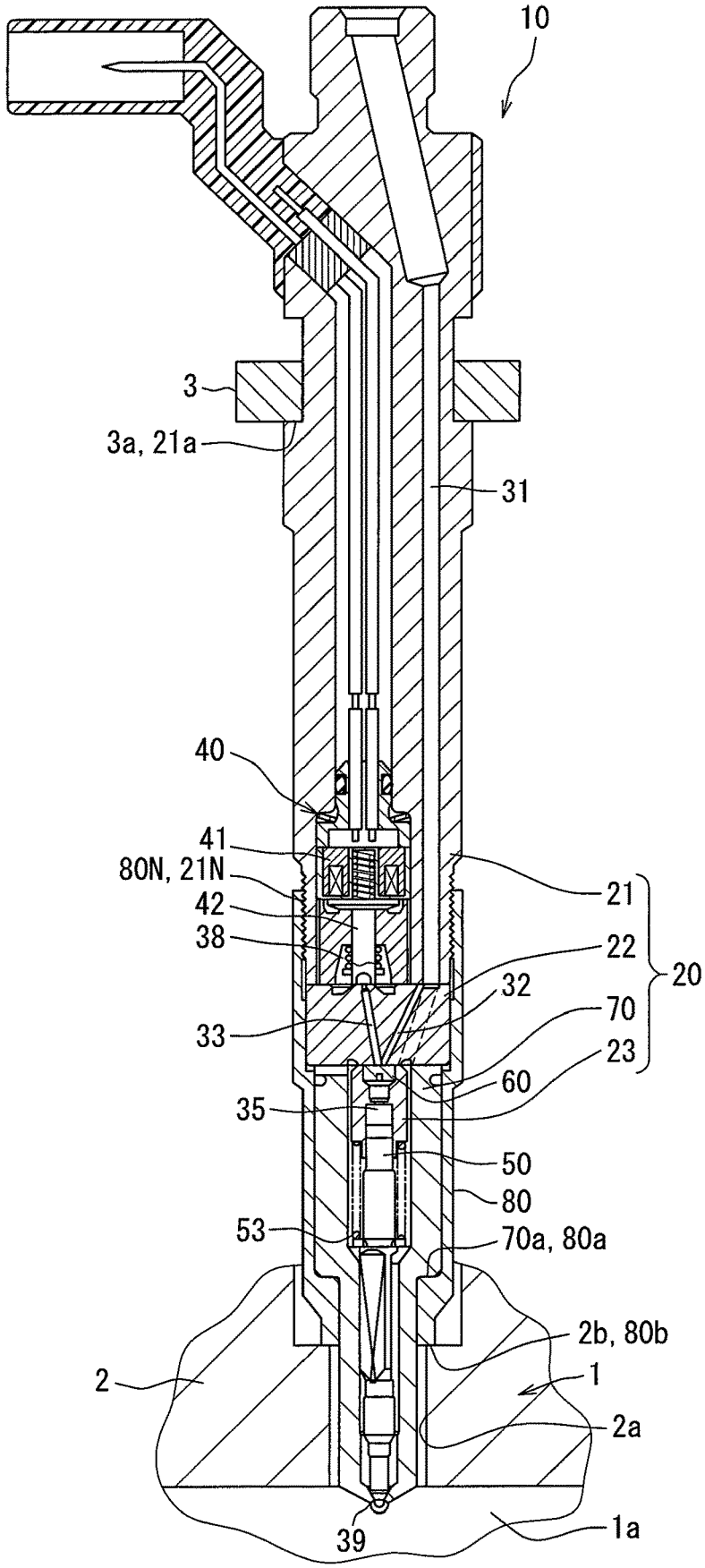
FIG. 1 is a cross-sectional view showing a state in which a fuel injection valve is mounted on an internal combustion engine according to a first embodiment.

To begin with, an example of the present disclosure will be described as follows. A fuel injection valve for an internal combustion engine includes a metallic nozzle. The metallic nozzle has an injection hole for injecting fuel. In the present example, plating is applied to the surface of the nozzle in order to reduce erosion of the nozzle.

It is conceivable that the nozzle has a high stress portion which is applied with plating and in which a high stress arises. In the conceivable condition, the portion of the nozzle may be presumably reduced in corrosion resistance due to the high stress, and consequently, the portion of the nozzle may not exhibit sufficient corrosion resistance. In other words, even though the high stress portion is applied with plating, the plated portion would hardly secure its corrosion resistance at a sufficient level due to, for example, occurrence of cracking. In consideration of such an issue, a configuration may be conceivable which enables to restrict occurrence of cracks in a plated layer applied to such a high stress portion. The configuration may be provided as a corrosion resistant device configured to sufficiently secure its corrosion resistance.

As follows, a description will be made on an assumable corrosion resistant device. The corrosion resistant device includes a first member having a plated layer applied to a metal base material. The corrosion resistant device further includes a second member pressed against a portion of the first member on which the plated layer is applied.

Further details of the example of the corrosion resistant device will be described. Specifically, a tensile stress is caused in the first member by pressing the second member against the first member. A breakage probability is a probability of breakage of the plated layer caused by the tensile stress. A characteristic slope is a slope of a characteristic line, which represents a relationship between an elastic modulus of the plated layer and the breakage probability. The slope is a ratio of an increase amount of the breakage probability to a decrease in the elastic modulus by a predetermined amount.

A change point appears at a characteristic change point on the characteristic line, at which the elastic slope changes from a slope, which is less than a predetermined slope, to a predetermined slope or more, as the elastic modulus gradually decreases. The elastic modulus at the characteristic change point is a characteristic change elastic modulus.

The plated layer contains at least a chromium component, and in addition, has the elastic modulus larger than the characteristic change elastic modulus.

Use of chromium as a material for plating could be effective to increase the elastic modulus of the plating. Thus, cracks are less likely to occur even when plating is applied to a high stress portion. According to the above corrosion resistant device in consideration of this point, the plated layer contains at least the chromium component and has the elastic modulus larger than the characteristic change elastic modulus. For that reason, the configuration could enable to restrict the occurrence of the crack in the plated layer applied to the portion (high stress portion) of the first member where the second member is pressed to cause the high stress, and to sufficiently secure the corrosion resistance by the plated layer.

Hereinafter, multiple embodiments of the present disclosure will be described with reference to the drawings. The same reference numerals are assigned to the corresponding components in each embodiment, and duplicate descriptions may be omitted. When only a part of the configuration is described in each embodiment, the configuration of the other embodiments described above can be applied to other parts of the configuration.

First Embodiment

A corrosion resistant device according to the present embodiment is a fuel injection valve 10 shown in FIG. 1. The fuel injection valve 10 is provided in a combustion system mounted on a vehicle. Specifically, the fuel injection valve 10 is attached to a cylinder head 2 of an internal combustion engine 1 configuring the combustion system. The fuel injection valve 10 directly injects a high-pressure fuel supplied from a common rail from an injection hole 39 toward a combustion chamber 1*a*.

The fuel injection valve 10 includes a valve body 20, a nozzle needle 50, a solenoid control valve 40, and a movable plate 60. The valve body 20 is formed by combining multiple metal members such as an injector body 21, a flow channel forming member 22, a nozzle body 70, and a cylinder 23 with a retaining nut 80.

The retaining nut 80 is made of metal and has a cylindrical shape extending in an axial direction of the fuel injection valve 10. A female threaded portion 80N is provided at one end of an inner peripheral surface of the retaining nut 80 in the axial direction, and a nut locking portion 80*a* is formed at the other end. In a state in which the nut locking portion 80*a* locks a body locking portion 70*a* which is a locking portion of the nozzle body 70, the female threaded portion 80N of the retaining nut 80 is fastened to a male threaded portion 21N formed on an outer peripheral surface of the injector body 21. As a result, the injector body 21, the flow channel forming member 22, and the nozzle body 70 are held in a state of being pressed against each other in the axial direction.

The fuel injection valve 10 is inserted into the insertion hole 2*a* of the cylinder head 2, and an injection hole 39 provided at a tip of the valve body 20 is exposed to the combustion chamber 1*a*. One end of a clamp member 3 is engaged with an engagement portion 21*a* of the injector body 21. The other end of the clamp member 3 is fixed to the cylinder head 2 by a screw or the like. An abutment portion 80*b* of the retaining nut 80 abuts against an abutment portion 2*b* located inside the insertion hole 2*a* of the cylinder head 2. The abutment restricts the fuel injection valve 10 from moving toward the combustion chamber 1*a* in the axial direction. In other words, the fuel injection valve 10 is attached to the insertion hole 2*a* of the cylinder head 2 while being sandwiched between the abutment portion 2*b* of the cylinder head 2 and the clamp member 3.

A high-pressure fuel passage 31, an inflow flow channel 32, an outflow flow channel 33, a control chamber 35, and a low-pressure chamber 38 are provided inside the valve body 20.

The high-pressure fuel passage 31 is provided over the injector body 21, the flow channel forming member 22, and the nozzle body 70, and allows a high-pressure fuel supplied from the common rail not shown to flow through the injection hole 39.

The inflow flow channel 32 is branched from the high-pressure fuel passage 31 by the flow channel forming member 22, and communicates the high-pressure fuel passage 31 with the control chamber 35. The inflow flow channel 32 allows a part of the high-pressure fuel flowing through the high-pressure fuel passage 31 to flow into the control chamber 35. The outflow flow channel 33 communicates the control chamber 35 with the low-pressure chamber 38 to allow the fuel to flow out of the control chamber 35.

The control chamber 35 is a space defined by the flow channel forming member 22, the cylinder 23, the nozzle needle 50, and the like. The control chamber 35 is located on the opposite side of the injection hole 39 across the nozzle needle 50. The control chamber 35 is filled with the fuel supplied through the inflow flow channel 32. The fuel pressure in the control chamber 35 is varied due to an inflow of the fuel through the inflow flow channel 32 and an outflow of the fuel through the outflow flow channel 33.

The low-pressure chamber 38 is an accommodation space provided in the injector body 21. A solenoid control valve 40 is accommodated in the low-pressure chamber 38. An excess fuel discharged through the outflow flow channel 33 flows into the low-pressure chamber 38, and the low-pressure chamber 38 is filled with the fuel having a lower pressure than that of the control chamber 35.

The nozzle needle 50 is made of a metal material in a cylindrical shape. The nozzle needle 50 is displaced relative to the valve body 20 along the axial direction by the variation of the fuel pressure in the control chamber 35, and opens and closes the injection hole 39. The tip of the nozzle needle 50 on the injection hole 39 side is formed in a conical shape. The nozzle needle 50 is accommodated in the nozzle body 70, and receives a force in a direction in which the injection hole 39 is opened (hereinafter referred to as a "valve opening direction") from the high-pressure fuel supplied through the high-pressure fuel passage 31. The nozzle needle 50 is urged by an urging force of a needle spring 53 toward the cylinder 23 in a direction in which the injection hole 39 is closed (hereinafter referred to as a "valve closing direction").

The solenoid control valve 40 includes a control valve body 42 that is accommodated in the low-pressure chamber 38 for opening and closing the outflow flow channel 33, and a drive unit 41 for displacing the control valve body 42 based on a drive current. When no electric power is supplied to the drive unit 41, the control valve body 42 closes the valve to interrupt fuel outflow from the control chamber 35 to the low-pressure chamber 38. On the other hand, when the electric power is supplied to the drive unit 41, the control valve body 42 opens the value to allow the fuel to flow from the control chamber 35 to the low-pressure chamber 38.

The movable plate 60 is made of a metal material in a disk shape. The movable plate 60 is disposed in the control chamber 35, and reciprocates along the axial direction of the nozzle needle 50 to open and close the outflow flow channel 33. When the outflow flow channel 33 is opened by the control valve body 42, the fuel in the control chamber 35 is discharged from the outflow flow channel 33 to the low-pressure chamber 38.

Figure 2:
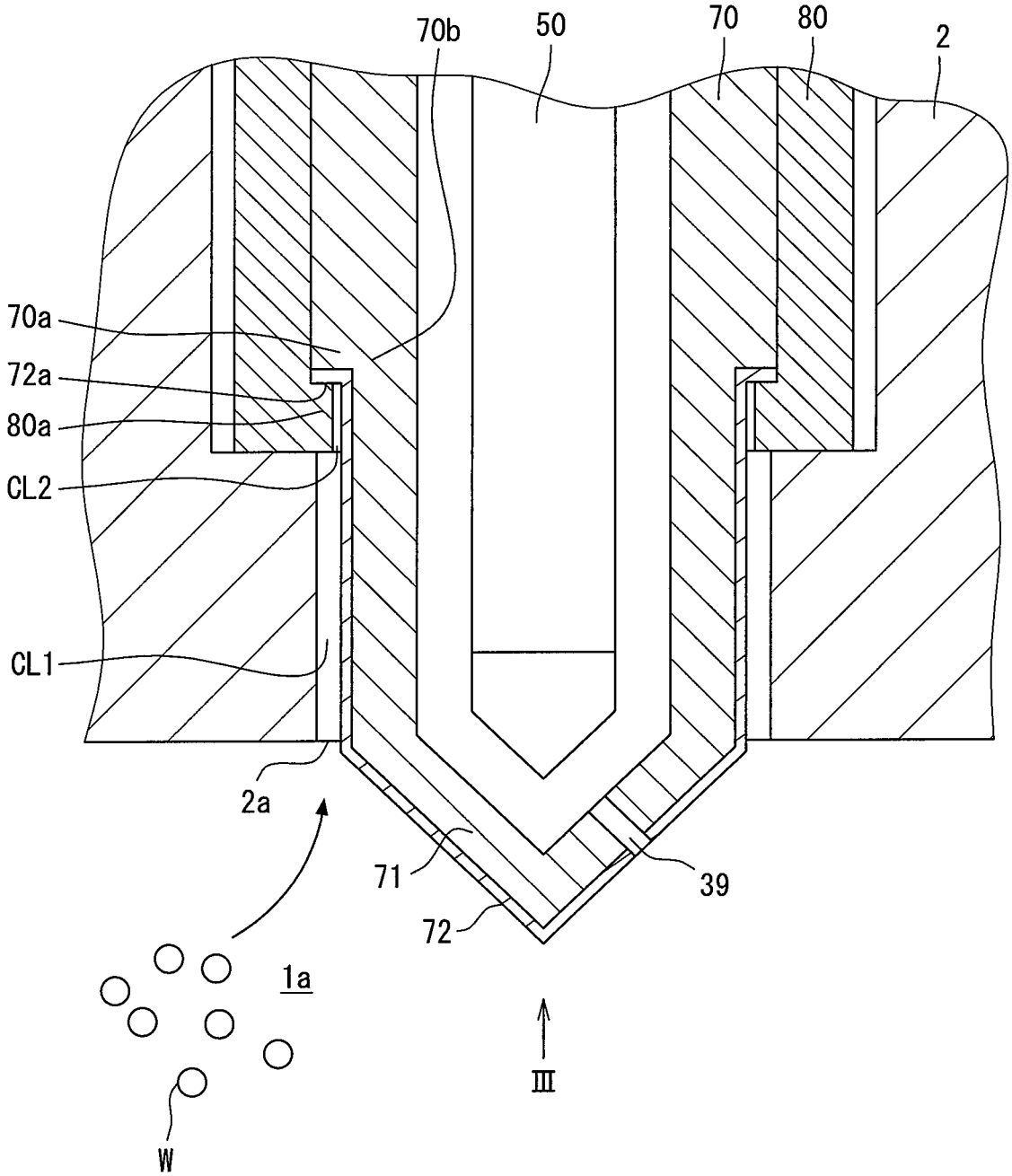
FIG. 2 is a cross-sectional view schematically showing FIG. 1, which is taken along a line II-II of FIG. 3.
Figure 3:
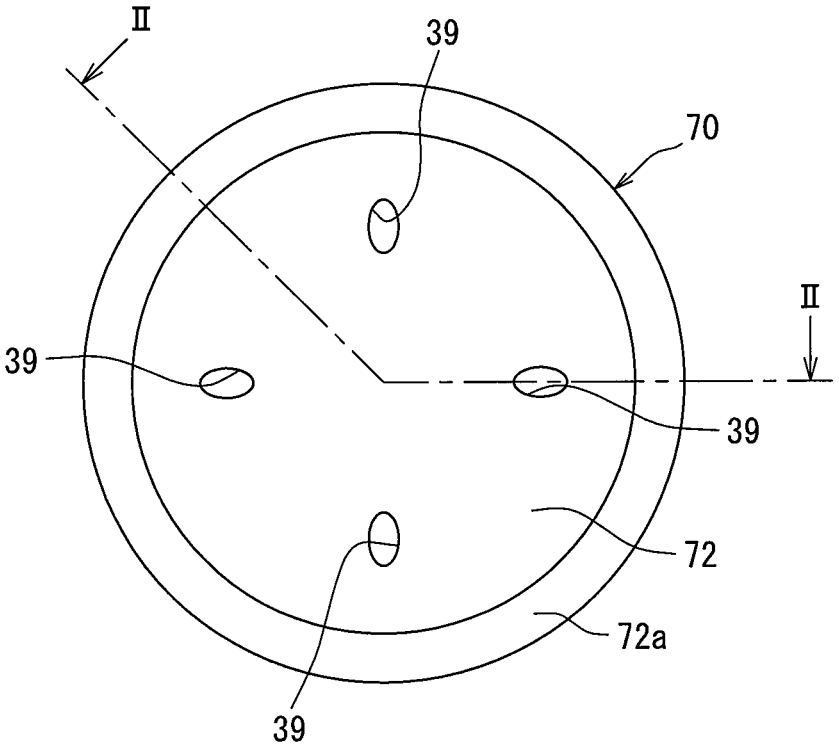
FIG. 3 is a view taken along an arrow III of FIG. 2.

Hereinafter, a structure of the nozzle body 70 will be described in detail with reference to FIGS. 2 and 3.

As described above, the injector body 21 and the retaining nut 80 are screwed together in a state in which the retaining nut 80 and the nozzle body 70 are locked with each other. As a result, the injector body 21, the flow channel forming member 22, and the nozzle body 70 are pressed against each other in the axial direction. In this manner, the body locking portion 70*a* is in a state of being pressed against the nut locking portion 80*a*, and a pressing force (pushing force) is applied in the axial direction by a screw engagement between the female threaded portion 80N and the male threaded portion 21N. The nozzle body 70 corresponds to a "first member" and the retaining nut 80 corresponds to a "second member".

The nozzle body 70 has a base material 71 and a plated layer 72, and the nozzle body 70 is formed by applying the plated layer 72 to an outer surface of the base material 71. The base material 71 is made of an iron based metal. The plated layer 72 is hard chromium plating based on chromium. The plated layer 72 is provided in an entire area of an outer surface of the nozzle body 70 from a portion where the injection hole 39 is provided to the body locking portion 70*a*, that is, in the body locking portion 70*a* and an entire portion on the injection hole side from the body locking portion 70*a* in the axial direction. In other words, the plated layer 72 is applied to an area of the outer surface of the nozzle body 70 from a portion where the injection hole 39 is provided to a portion pressed against the retaining nut 80. An inside of the injection hole 39 and an inner surface of the base material 71 are not plated.

A gap CL1 is provided between the plated layer 72 and an inner peripheral surface of the insertion hole 2*a*. A gap CL2 is also provided between the inner peripheral surface of the nut locking portion 80*a* of the retaining nut 80 and the plated layer 72. A surface 72*a* of the plated layer 72 in a portion forming the body locking portion 70*a* contacts the nut locking portion 80*a* and is pressed by the pressing force described above. The surface 72*a* has a shape extending perpendicularly to the axial direction and a shape extending annularly around the center axis.

Next, a manufacturing procedure for forming the plated layer 72 on the base material 71 will be described. First, a masking treatment is performed on a portion of the base material 71 except a portion where the plated layer 72 is to be formed (masking process). In addition, a Sargent bath made of molten chromium is prepared, and a bath temperature, which is a temperature of molten chromium, is set to a target temperature (bath temperature adjustment process). Next, the base material 71 is immersed in a temperature-adjusted Sargent bath, and the base material 71 is electrically connected to the cathode (immersion process). Next, with the energization of an anode and a cathode, the molten chromium is precipitated on a portion of the surface of the base material 71 which has not been subjected to a masking treatment (energization process).

In this case, the plated layer 72 has minute scratches such as fine cracks and voids caused in the precipitation process. The degree to which such minute scratches occur can be adjusted by adjusting a precipitation rate of the plating in the energization process. The precipitation rate can be adjusted by adjusting the bath temperature in a bath temperature adjustment process and a current value related to the energization in the energization process. An elastic modulus of the plated layer 72 can be adjusted by adjusting the precipitation rate.

The elastic modulus is an indentation elastic modulus as defined in the International Organization for Standardization (ISO) 14577. In other words, a load removal amount and a recovery amount are measured when the plated layer 72 is deformed by pressing an indenter into the plated layer 72 for giving a load and then removing the load to restore the deformation. A ratio obtained by dividing the load removal amount measured in this manner by the recovery amount is defined as the indentation elastic modulus. A portion of the plated layer 72 pressed in contact with the indenter is plastically deformed following a shape of the indenter. A portion of the plated layer 72 surrounding the portion in contact with the indenter is elastically deformed. Specific examples of the indenter used for the above measurement include a Berkovich type and a Vickers indenter defined by the International Organization for Standardization (ISO) 14577. The indentation elastic modulus is measured under the conditions that a Poisson's ratio of the plating is 0.3, a Poisson's ratio of the indenter is 0.070, and an elastic modulus of the indenter is $1.14\times10^6$ N/mm$^2$.

Figure 4:
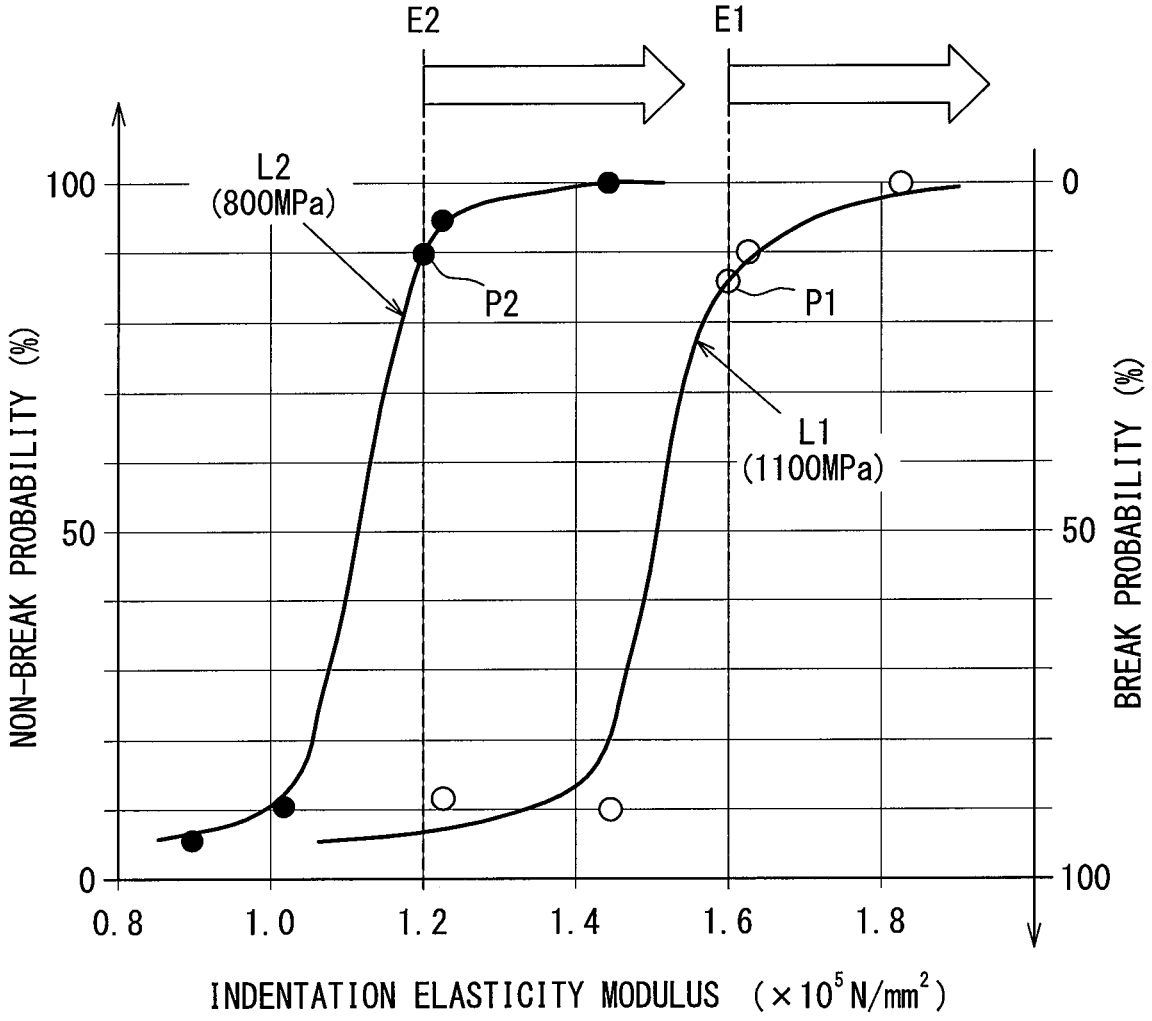
FIG. 4 is a test result showing a characteristic line representing a relationship between an indentation elastic modulus of a plated layer and a breakage probability as well as a non-breakage probability.

The indentation elastic modulus of the plated layer 72 is set to be larger than $1.6\times10^5$ N/mm$^2$ (refer to FIG. 4). The technical significance of the indentation elastic modulus will be described below with reference to FIGS. 4 to 8.

Figure 5:
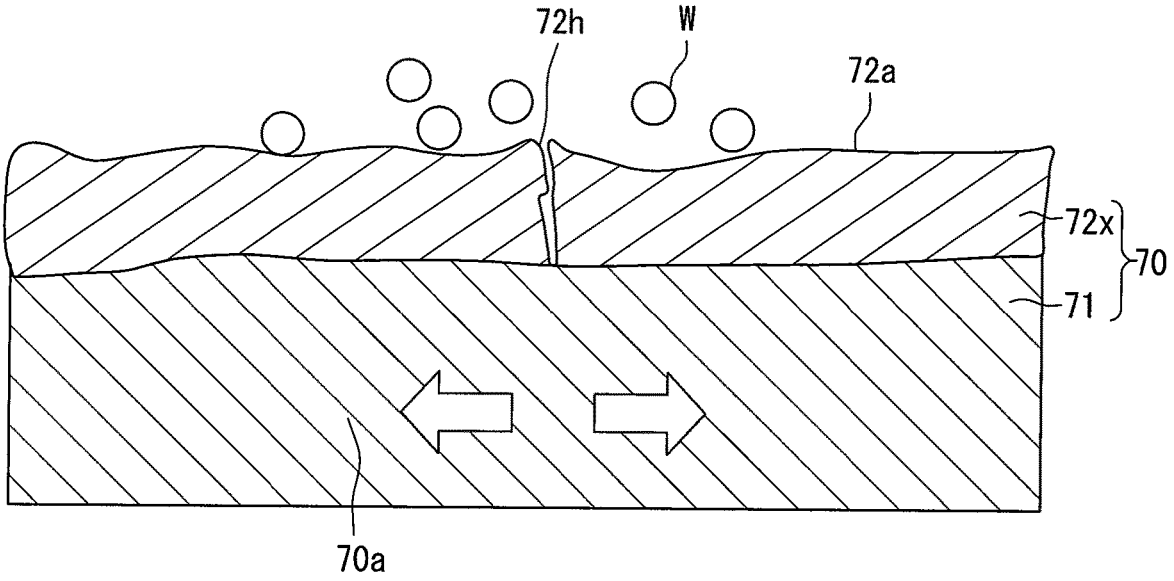
FIG. 5 is a cross-sectional view showing a nozzle body of a fuel injection valve according to a comparative example, which shows a state in which a crack occurs in a plated layer due to a stress occurring in a base material.

As indicated by arrows in FIG. 5, the base material 71 of the body locking portion 70*a* can be deformed by an internal stress (tensile stress) caused by the pressing force described above. In addition, the base material 71 can also be deformed by the pressing force by the clamp member 3 described above. Subsequently, the plated layer 72*x* of the body locking portion 70*a* cannot be elastically deformed following the deformation of the base material 71, and as shown in FIG. 5, a crack 72*h* occurs in the plated layer 72*x*. When the crack 72*h* penetrates through the plated layer 72*x* from the surface 72*a* to the base material 71, moisture W adhering to the surface 72*a* would penetrate into the crack 72*h* and reach the base material 71. As a result, as shown in FIG. 6, the base material 71 corrodes, and a void 71*h* may occur due to the corrosion.

Figure 6:
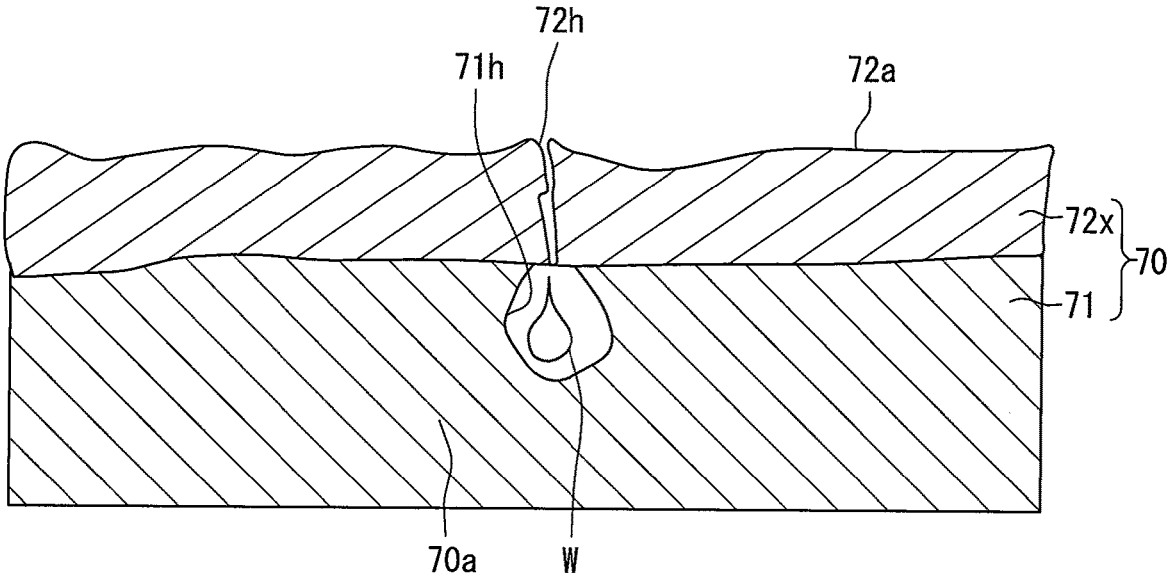
FIG. 6 is a cross-sectional view showing a nozzle body of a fuel injection valve according to the comparative example, which shows a state in which a base material is corroded due to the crack occurring in the plated layer.
Figure 7:
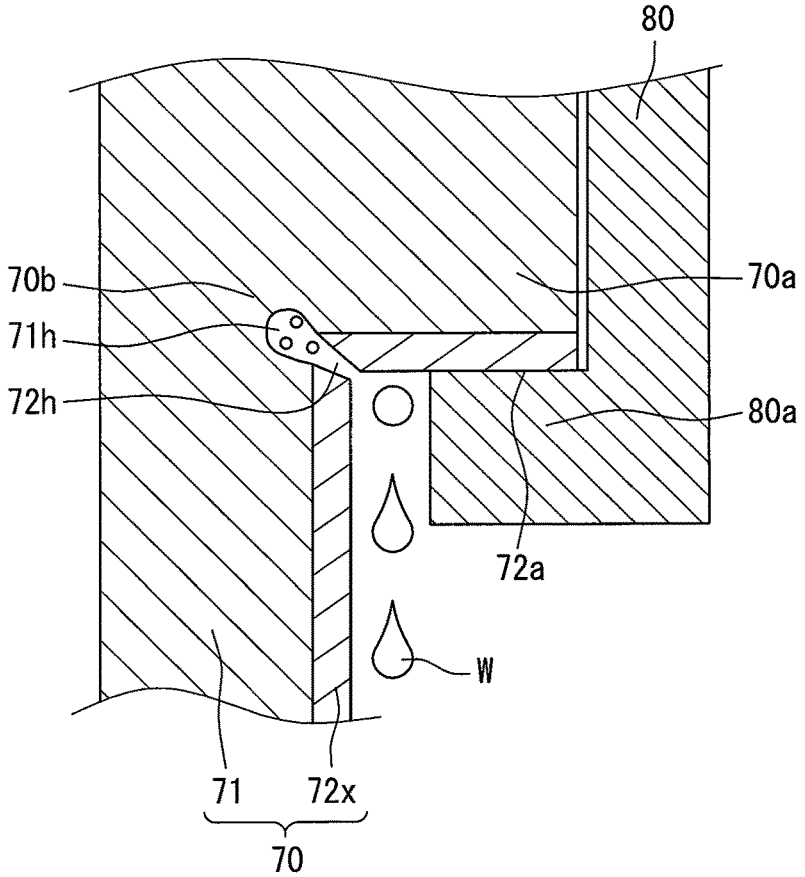
FIG. 7 is a cross-sectional view showing a nozzle body and a retaining nut of a fuel injection valve according to the comparative example, which shows a state in which the base material is corroded.

FIGS. 5 and 6 show an example in which the crack 72*h* occurs in a portion of the plated layer 72*x* which comes into contact with the retaining nut 80. On the other hand, FIG. 7 shows an example in which a crack occurs in a portion of the plated layer 72*x* which does not come into contact with the retaining nut 80 and in a portion in which the base material 71 is bent at a right angle (bent portion 70*b*). In the case of FIG. 7, similarly to FIGS. 5 and 6, the base material 71 is deformed by the internal stress caused in the bent portion 70*b*, and the plated layer 72*x* cannot be elastically deformed following the deformation, and the crack 72*h* is caused in the plated layer 72*x*. As a result of the moisture W penetrating into the crack 72*h* and reaching the base material 71, the base material 71 corrodes and the void 71*h* occurs.

In particular, the combustion chamber 1*a* contains moisture generated by combustion, and the moisture contains acidic components such as a nitrogen compound and a sulfur compound. For that reason, when the moisture reaches the bent portion 70*b* and the body locking portion 70*a* through the gaps CL1 and CL2, the corrosion described above easily progresses. When the void 71*h* occurs in the base material 71 as described above, the nozzle body 70 may be damaged due to a decrease in strength.

Figure 8:
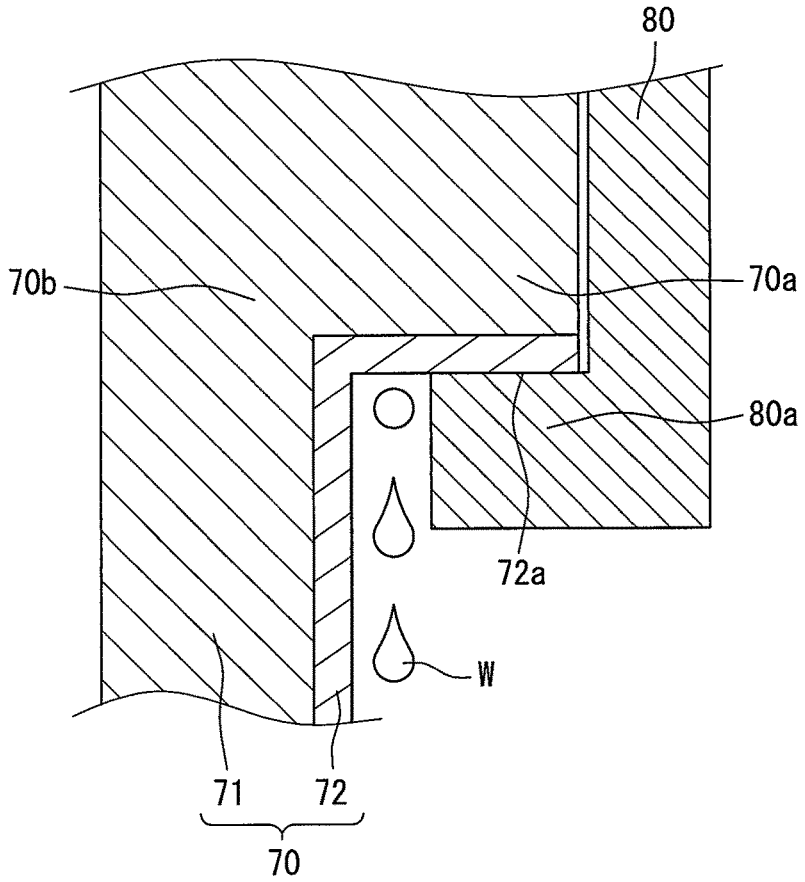
FIG. 8 is a cross-sectional view showing a nozzle body and a retaining nut of the fuel injection valve according to the first embodiment, which shows a state in which the base material is protected by the plated layer and does not corrode.

Therefore, in the present embodiment, in order to reduce the occurrence of cracks 72*h* in the plated layer 72*x*, the elastic modulus of the plated layer 72 is formed to be sufficiently large. As a result, since the plated layer 72 can be sufficiently elastically deformed by following the deformation of the base material 71, no or less crack occurs in the plated layer 72, and the base material 71 is protected from corrosion as shown in FIG. 8.

In the fuel injection valve 10 shown in FIG. 1, the tensile stress is 1100 MPa. In this instance, if the indentation elastic modulus of the plated layer 72 is larger than $1.6\times10^5$ N/mm$^2$, a breakage probability to be described below can be sufficiently lowered. The breakage probability is a probability that damage such as a crack or the like occurs in the plated layer 72 due to the tensile stress. The non-breakage probability is a probability that no damage such as crack or the like occurs in the plated layer 72 due to the tensile stress, and for example, the case where the breakage probability is 30% is synonymous with the case where the non-breakage probability is 70%.

Solid lines in FIG. 4 are characteristic lines L1 and L2 representing a relationship between the indentation elastic modulus and the breakage probability of the plated layer 72. The characteristic line L1 is a characteristic line in the case where the tensile stress is 1100 MPa, and is derived from a test result shown by white circles in the drawing. The characteristic line L2 is a characteristic line when the tensile stress is 800 MPa, and is derived from a test result shown by black circles in the drawing. As shown in FIG. 4, the higher the indentation elastic modulus, the lower the breakage probability. However, even if the indentation elastic modulus is larger than the indentation elastic moduli at change points P1 and P2, which will be described later, the breakage probability is not lowered much.

Slopes of the characteristic lines L1 and L2, each of which are a ratio of an increase amount of the breakage probability to a decrease in the indentation elastic modulus by a predetermined amount, are defined as characteristic slopes. Change points appearing on the characteristic lines L1 and L2 at which the characteristic slope changes from a slope less than a predetermined slope to a predetermined slope or more as the indentation elastic modulus is gradually decreased are defined as characteristic change points P1 and P2. The indentation elastic moduli at the characteristic change points P1 and P2 are defined as characteristic change elastic moduli E1 and E2.

In the fuel injection valve 10 according to the present embodiment, since the tensile stress is 1100 MPa, the indentation elastic modulus of the plated layer 72 is set to be larger than $1.6\times10^5$ N/mm$^2$ in accordance with the characteristic line L1. On the other hand, for example, in the case of the fuel injection valve in which the tensile stress is 800 MPa, it is desirable that the indentation elastic modulus of the plated layer 72 is set to be larger than $1.2\times10^5$ N/mm$^2$ in accordance with the characteristic line L2. The precipitation rate of the plating is adjusted by adjusting the bath temperature and the current value so as to obtain such an indentation elastic modulus. The film thickness of the plated layer 72 is adjusted to be 0.1 μm or more and less than 10 μm.

As described above, according to the present embodiment, the plated layer 72 includes at least a chromium component and has the indentation elastic modulus larger than the characteristic change elastic modulus E1. For that reason, the occurrence of the crack 72*h* can be restricted in the plated layer 72 applied to the portion (high stress portion) of the nozzle body 70 (first member) against which the retaining nut 80 (second member) is pressed and becomes high stress. As a result, the corrosion resistance of the plated layer 72 can be sufficiently ensured.

Further, in the present embodiment, the fuel injection valve 10 is mounted on the combustion system having the internal combustion engine 1, and the nozzle body 70 is mounted on the combustion system so as to be exposed to an exhaust gas of the internal combustion engine 1. For that reason, since the moisture W containing the acidic component such as a nitrogen compound or a sulfur compound is attached to the nozzle body 70, a requirement for corrosion resistance of the nozzle body 70 is high. Therefore, the effect of "sufficient corrosion resistance can be ensured" described above is suitably exhibited.

Further, in the present embodiment, the first member and the second member are provided in the fuel injection valve 10 for injecting the fuel into the combustion chamber 1*a* of the internal combustion engine 1. The tensile stress as a condition for specifying the characteristic lines L1 and L2 is a magnitude generated in a state where the fuel injection valve 10 is mounted on the combustion system. As described above, a large tensile stress acts on the fuel injection valve 10, and a requirement for corrosion resistance is high, so that the effect of "sufficient corrosion resistance can be ensured" described above is suitably exhibited.

Further, in the present embodiment, the tensile stress caused when the fuel injection valve 10 is mounted on the combustion system is 1100 MPa, and the characteristic change elastic modulus in the characteristic line L1 is $1.6\times10^5$ N/mm$^2$. Therefore, in the present embodiment, since the elastic modulus is set to be larger than $1.6\times10^5$ N/mm$^2$, it is possible to reduce the occurrence of the crack 72*h* in the plated layer 72.

Further, in the present embodiment, the plated layer 72 is applied in a range from a portion of the nozzle body 70 where the injection hole 39 is formed to a portion of the nozzle body 70 which is pressed against the retaining nut 80. Since the above range is a portion exposed to the exhaust gas, the moisture W containing the acidic component may adhere to the range. Therefore, the effect of "sufficient corrosion resistance can be ensured" described above is suitably exhibited.

Further, in the present embodiment, the film thickness of the plated layer 72 is 0.1 μm or more and less than 10 μm. This makes it possible to restrict the corrosion resistance and the abrasion resistance from becoming inadequate due to an excessively thin film thickness. For example, in a case where the film thickness of the plated layer 72 is less than 0.1 μm contrary to the present embodiment, there is a concern that the moisture W reaches the base material 71 through the void existing in the plated layer 72 even though the crack 72*h* does not occur. On the other hand, in the present embodiment, since the film thickness of the plated layer 72 is 0.1 μm or more, the above-mentioned concern can be reduced. Further, since the film thickness of the plated layer 72 is less than 10 μm, it is possible to restrict a precipitation time of plating from becoming longer than necessary because the film thickness is excessively thick.

Second Embodiment

In the first embodiment, no plated layer is formed on the surface of the retaining nut 80, whereas in the present embodiment, the plated layer is also formed on the surface of the retaining nut 80. In the following description, the base material 71 and the plated layer 72 included in the nozzle body 70 are referred to as a first base material and a first plated layer, and the base material and the plated layer included in the retaining nut 80 are referred to as a second base material and a second plated layer.

Figure 9:
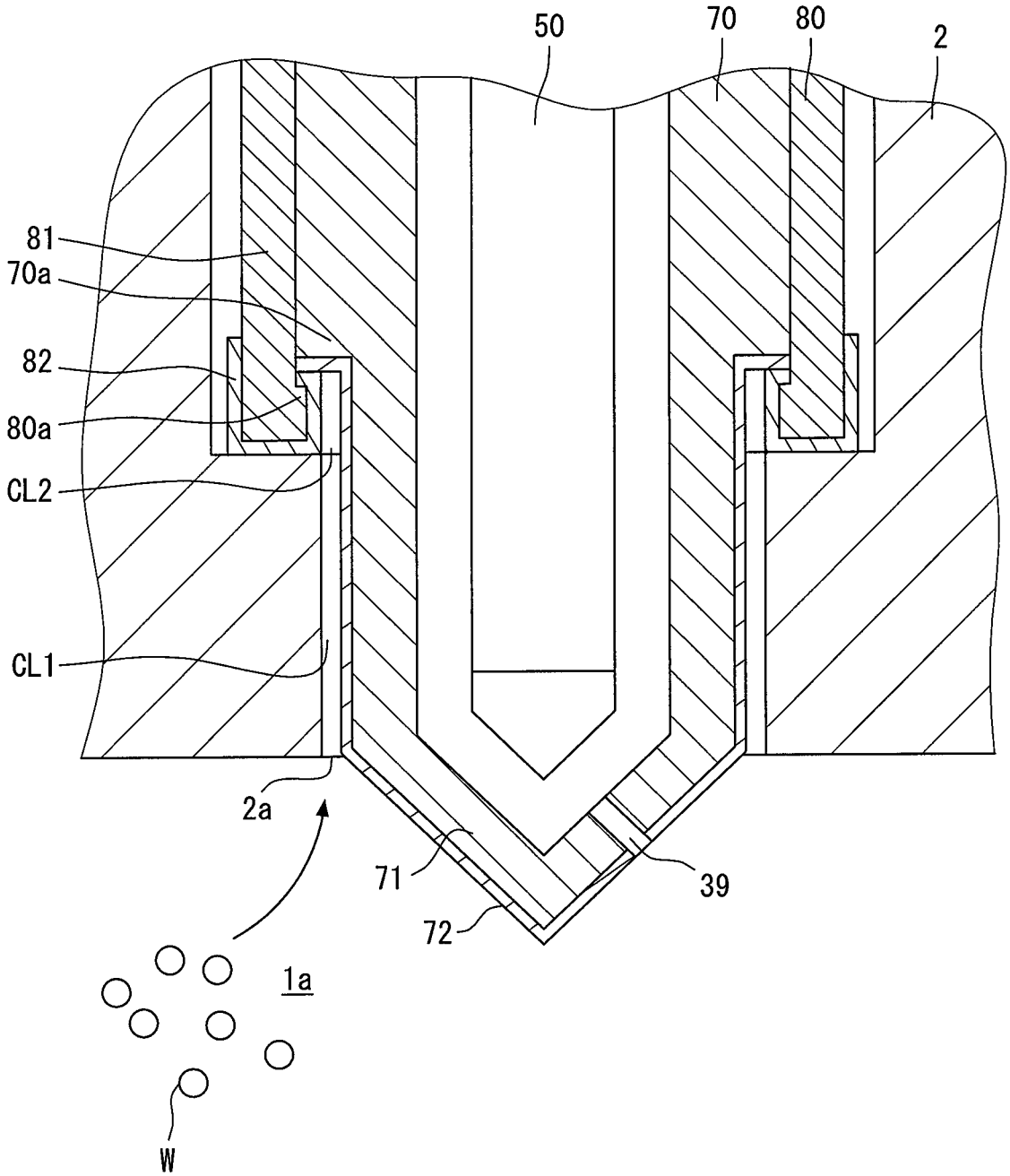
FIG. 9 is a cross-sectional view schematically showing a fuel injection valve according to a second embodiment.

As shown in FIG. 9, the retaining nut 80 according to the present embodiment includes a second base material 81 made of metal and a second plated layer 82 applied to a second base material 81. The second plated layer 82 is applied to at least a portion of the second base material 81 which is pressed against the nozzle body 70. In other words, the second plated layer 82 is pressed against the first plated layer. The second plated layer 82 is applied not only to the overall portion pressed against the first plated layer described above, but also to the entire portion providing the gap CL2, the entire portion contacting the cylinder head 2, and a portion of the outer peripheral surface of the second base material 81.

The material and the film thickness of the second plated layer 82 are the same as those of the first plated layer. The method of manufacturing the second plated layer 82 is also the same as that of the first plated layer, and the elastic modulus of the second plated layer 82 can be adjusted by adjusting the precipitation rate of plating.

In the same manner as the tensile stress shown by the arrows in FIG. 5, the retaining nut 80 is pressed against the nozzle body 70, whereby an internal stress is also generated in the retaining nut 80. Among the internal stresses, the stress caused in the nut locking portion 80*a* is referred to as a second tensile stress. The probability of breakage of the second plated layer 82 due to the second tensile stress is defined as a second breakage probability. The second characteristic line representing a relationship between the second elastic modulus, which is the elastic modulus of the second plated layer 82, and the second breakage probability is the same as that of the characteristic lines L1 and L2 (first characteristic lines) shown in FIG. 4.

Therefore, the slope of the second characteristic line, which is the ratio of the increase amount of the second breakage probability to the decrease in the second elastic modulus by a predetermined amount, is the same as the characteristic slope of the first characteristic line (first characteristic slope). The second characteristic change point, which is a change point appearing on the second characteristic line and at which the second characteristic slope changes from a slope less than a predetermined slope to a predetermined slope or more as the second elastic modulus is gradually decreased, is also the same as the characteristic change points P1 and P2 (first characteristic change point) appearing on the first characteristic line. The second elastic modulus at the second characteristic change point is defined as the second characteristic change electric modulus, and the second plated layer 82 is formed so that the second elastic modulus of the second plated layer 82 is larger than the second characteristic change elastic modulus.

As described above, according to the present embodiment, the second plated layer 82 includes at least the chromium component and has the second indentation elastic modulus larger than the second characteristic change elastic modulus. This makes it possible to restrict the occurrence of the crack in the second plated layer 82 applied to the portion (high stress portion) of the retaining nut 80 (second member) where the nozzle body 70 (first member) is pressed into a high stress. As a result, the corrosion resistance of the second plated layer 82 can be sufficiently ensured.

In addition, the second plated layer 82 applied to the portion of the retaining nut 80 where the cylinder head 2 is pressed into the high stress can also be restricted from cracking due to the stress.

Third Embodiment

Similarly to the first embodiment, in the fuel injection valve 10 according to the present embodiment, the internal stress (tensile stress) caused in the base material 71 of the body locking portion 70*a* is 1100 MPa. Similarly, the plated layer 72 according to the present embodiment contains at least chromium component, and its indentation elastic modulus is set to be larger than $1.6\times10^5$ N/mm$^2$. In addition, as described below in detail, the plated layer 72 is formed to have a void ratio which is set to be equal to or less than 0.5%.

Figure 10:
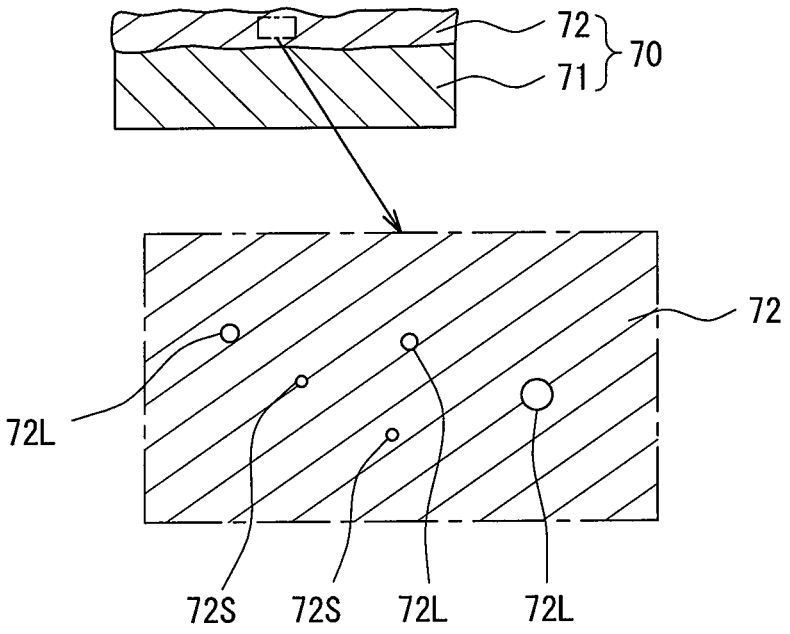
FIG. 10 is a cross-sectional view showing a nozzle body of the fuel injection valve according to a third embodiment in which the lower part is an enlarged view showing a part of a plated layer indicated by a chain line in the upper part.

As shown in FIG. 10, the plated layer 72 contains numerous voids 72L and 72S. Small voids 72S, which are small ones, hardly exert influence on the corrosion resistance of the plated layer 72. To the contrary, large voids 72L, which are large ones, decrease the corrosion resistance as those occupancy becomes larger. The large voids 72L represent voids, each of which has a volume of 0.001 μm$^2$ or larger, among voids 72L and 72S appearing in an arbitrary cross section of the plated layer 72. The void ratio represents a ratio of the large voids 72L residing in per unit area of the arbitrary cross section.

It is considered that the voids 72L and 72S are generated in the precipitation process among the manufacturing process for forming the plated layer 72. A ratio of generation of the large voids 72L can be adjusted by adjusting the precipitation rate of the plating in the energization process. The precipitation rate can be adjusted by adjusting the bath temperature in the bath temperature adjustment process and the current value in the energization implemented in the energization process. Thus, the void ratio can be adjusted by adjusting the precipitation rate.

As described above, according to the present embodiment, the plated layer 72 is formed to have the void ratio equal to or less than 0.5% thereby to enable to further enhance the corrosion resistance with the plated layer 72.

Although the multiple embodiments of the present disclosure have been described above, not only the combinations of the configurations explicitly shown in the description of each embodiment, but also the configurations of the multiple embodiments can be partially combined together even if the combinations are not explicitly shown if there is no problem in the combinations in particular. Unspecified combinations of the configurations described in the multiple embodiments and the modifications are also disclosed in the following description. Modifications of the embodiments described above will be described.

In the first embodiment, the tensile stress caused when the fuel injection valve 10 is mounted on the combustion system is 1100 MPa, but may be 800 MPa, for example. The characteristic change elastic modulus in the characteristic line L2 is $1.2\times10^5$ N/mm$^2$ (refer to FIG. 4). Therefore, when the tensile stress is 800 MPa, the elastic modulus of the plated layer 72 is desirably set to be larger than $1.2\times10^5$ N/mm$^2$.

In the case where the tensile stress is 800 MPa, the plated layer 72 contains at least chromium component, its indentation elastic modulus is set to $1.2\times10^5$ N/mm$^2$ or more, and furthermore, the plated layer 72 may be formed to have the void ratio equal to or less than 1.0%.

Figure 11:
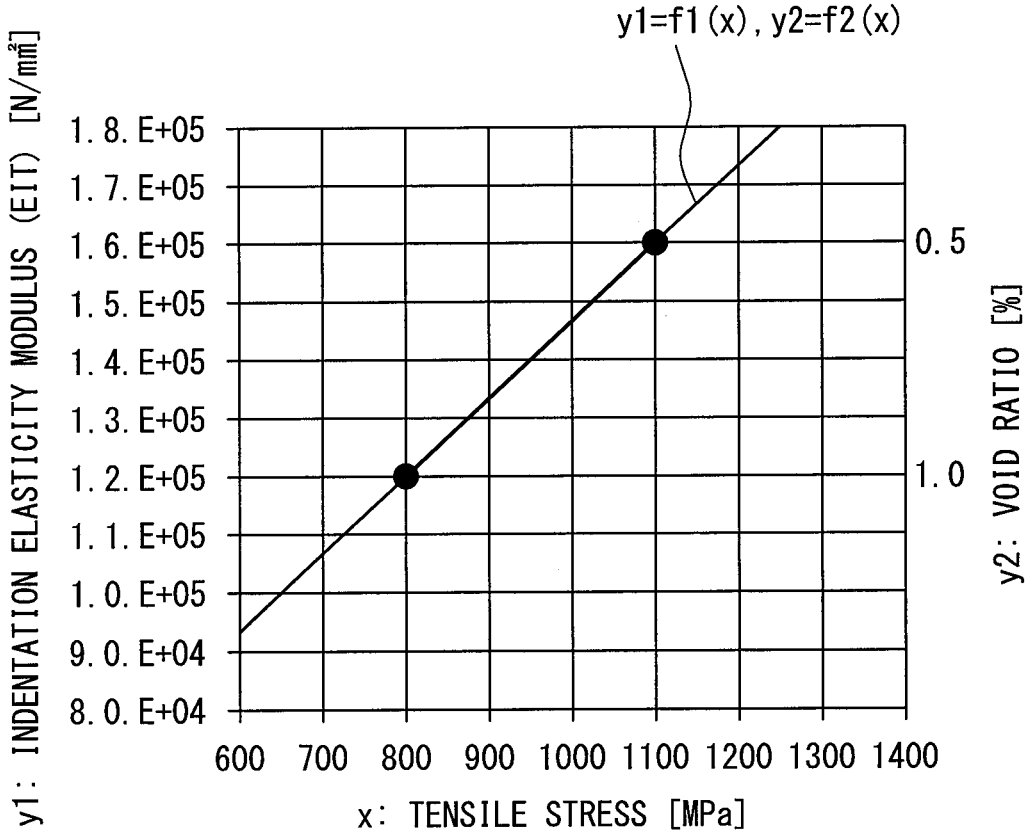
FIG. 11 is a view showing a relation among an indentation elastic modulus, a void ratio, and a tensile stress.

In FIG. 11, the vertical axis shown on the left side represents the indentation elastic modulus (characteristic change elastic modulus) at the characteristic change point. As shown in FIG. 11, as the tensile stress caused in the fuel injection valve 10 becomes larger, the characteristic change elastic modulus becomes larger. In other words, assuming that the tensile stress is a variable x, and the characteristic change elastic modulus is a variable y1, a function f1 represented by y1=f1(x) is a linear function in which as the variable x becomes larger, the variable y1 becomes larger. The liner function f1 has an inclination, which is 400/3, and an intercept, which is 40000/3. The plated layer 72 may be formed such that the plated layer 72 has its elastic modulus, which is greater than the characteristic change elastic modulus specified by the linear function f1.

In FIG. 11, the vertical axis shown on the right side represents the void ratio in a condition where the non-breakage probability is 90%. As shown in FIG. 11, as the tensile stress caused in the fuel injection valve 10 becomes larger, the void ratio in the condition where the non-breakage probability is 90% becomes smaller. In other words, assuming that the tensile stress is a variable x, and the void ratio in the condition where the non-breakage probability is 90% is a variable y2, a function f2 represented by y2=f2($x$) is a linear function in which as the variable x becomes larger, the variable y2 becomes smaller. The liner function f2 has an inclination, which is −1/600, and an intercept, which is 7/3. Assuming that the void ratio specified by the linear function f2 is set as an upper limit value, the plated layer 72 may be formed such that the plated layer 72 has its void ratio, which is less than the upper limit value.

In the first embodiment described above, the elastic modulus of the plated layer 72 is a ratio of the load removal amount to the recovery amount when the plated layer 72 is loaded and deformed and then the load is removed to restore the deformation. On the other hand, the elastic modulus of the plated layer 72 may be a ratio of the load application amount and the deformation amount when the plated layer 72 is loaded and deformed. Also, the indentation elastic module is not limited to the indentation elastic modulus defined by the International Standards Organization (ISO) 14577.

The combustion system to which the corrosion resistant device is applied may have an exhaust gas recirculation mechanism for mixing a part of the exhaust gas of the internal combustion engine 1 into the intake air as a recirculation gas. When the first member provided in the corrosion resistant device is disposed so as to be exposed to the recirculation gas, the above-mentioned influence of improving the corrosion resistance can be suitably exhibited.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to embodiments thereof, it is to be understood that the disclosure is not limited to the embodiments and constructions. The present disclosure is intended to cover various modification and equivalent arrangements. In addition, the various combinations and configurations, other combinations and configurations, including more, less or only a single element, are also within the spirit and scope of the present disclosure.

What is claimed is:

1. A corrosion resistant device comprising:

a first member having a plated layer applied to a metal base material; and a second member pressed against a portion of the first member on which the plated layer is applied, wherein a stress caused in the first member by pressing the second member against the first member is defined as a tensile stress, a probability of breakage of the plated layer caused by the tensile stress is defined as a breakage probability, a slope of a characteristic line, which represents a relationship between an elastic modulus of the plated layer and the breakage probability, is a ratio of an increase amount of the breakage probability to a decrease in the elastic modulus by a predetermined amount and is defined as a characteristic slope, a change point that appears on the characteristic line, at which the elastic slope changes from a slope, which is less than a predetermined slope, to a predetermined slope or more as the elastic modulus gradually decreases, is defined as a characteristic change point, the elastic modulus at the characteristic change point is defined as a characteristic change elastic modulus, and the plated layer contains at least a chromium component and has the elastic modulus larger than the characteristic change elastic modulus.

2. The corrosion resistant device according to claim 1, wherein the characteristic change elastic modulus is set to $1.6\times10^5$ N/mm$^2$ or more based on the characteristic line when the tensile stress is 1100 MPa.

3. The corrosion resistant device according to claim 2, wherein a void ratio is defined as a ratio of voids, each of which is 0.001 μm$^2$ or larger, among voids appearing in an arbitrary cross section of the plated layer, and the plated layer is formed to have the void ratio equal to or less than 0.5%.

4. The corrosion resistant device according to claim 1, wherein the characteristic change elastic modulus is set to $1.2\times10^5$ N/mm$^2$ or more based on the characteristic line when the tensile stress is 800 MPa.

5. The corrosion resistant device according to claim 4, wherein a void ratio is defined as a ratio of voids, each of which is 0.001 μm$^2$ or larger, among voids appearing in an arbitrary cross section of the plated layer, and the plated layer is formed to have the void ratio equal to or less than 1.0%.

6. The corrosion resistant device according to claim 1, wherein the elastic modulus is larger than the characteristic change elastic modulus which is specified by a liner function in which the tensile stress is a variable, and the linear function, which specifies the characteristic changer elastic modulus, has an inclination, which is 400/3, and an intercept, which is 40000/3.

7. The corrosion resistant device according to claim 1, wherein a void ratio is defined as a ratio of voids, each of which is 0.001 μm$^2$ or larger, among voids appearing in an arbitrary cross section of the plated layer, the void ratio is less than an upper limit value which is specified by a liner function in which the tensile stress is a variable, and the linear function, which specifies the upper limit value, has an inclination, which is −1/600, and an intercept, which is 7/3.

8. The corrosion resistant device according to claim 1, wherein the corrosion resistant device is configured to be mounted on a combustion system having an internal combustion engine, wherein the first member is configured to be mounted on the combustion system to be exposed to an exhaust gas of the internal combustion engine.

9. The corrosion resistant device according to claim 8, wherein the first member and the second member are configured to be provided in a fuel injection valve for injecting fuel into a combustion chamber of the internal combustion engine, and the tensile stress as a condition for specifying the characteristic line is a magnitude generated in a state in which the fuel injection valve is mounted on the combustion system.

10. The corrosion resistant device according to claim 9, wherein the first member has an injection hole for injecting fuel into the combustion chamber, and the plated layer is applied to an area spreading from one portion of an outer surface of the first member where the injection hole resides to another portion of the outer surface pressed against the second member.

11. The corrosion resistant device according to claim 1, wherein a film thickness of the plated layer is 0.1 μm or more and less than 10 μm.

12. The corrosion resistant device according to claim 1, wherein the second member includes a second plated layer that is pressed against the plated layer and a second base material made of a metal to which the second plated layer is applied, a stress caused in the second member by being pressed against the first member is defined as a second tensile stress, a probability of breakage occurring in the second plated layer by the second tensile stress is defined as a second breakage probability, a second characteristic line represents a relationship between a second elastic modulus, which is an elastic modulus of the second plated layer, and the second breakage probability, which is a ratio of an increase amount in the second breakage probability to a decrease in the second elastic modulus by a predetermined amount, a slope of the second characteristic line is defined as a second characteristic slope, a change point appearing in the second characteristic line, at which the second characteristic slope changes from a slope less than a predetermined slope to the predetermined slope or more as the second elastic modulus gradually decreases, is defined as a second characteristic change point, the second elastic module at the second characteristic change point is defined as a second characteristic change modulus, and the second plated layer has the second elastic modulus larger than the second characteristic change elastic modulus.

* * * * *